United States Patent [19]

Rivere

[11] 4,041,918

[45] Aug. 16, 1977

[54] FUEL INJECTION SYSTEM

[75] Inventor: Jean-Pierre Rivere, Paris, France

[73] Assignees: Regie Nationale des Usines Renault, Boulogne-Billancourt; Automobiles Peugeot, Paris, both of France

[21] Appl. No.: 637,629

[22] Filed: Dec. 4, 1975

[30] Foreign Application Priority Data

Dec. 13, 1974 France ..... 74.41170

[51] Int. Cl.[2] ..... F02M 69/00

[52] U.S. Cl. ..... 123/139 AW

[58] Field of Search ..... 123/139 AW

[56] References Cited

U.S. PATENT DOCUMENTS

| | | | |
|---|---|---|---|
| 2,136,959 | 11/1938 | Winfield | 123/139 AW |
| 3,739,762 | 6/1973 | Jackson | 123/139 AW X |
| 3,788,287 | 1/1974 | Falen | 123/139 AW X |

*Primary Examiner*—Robert G. Nilson

*Attorney, Agent, or Firm*—Beveridge, DeGrandi, Kline & Lunsford

[57] ABSTRACT

An indirect injection fuel feed system for an internal combustion engine, in which the engine air is supplied by a unit comprising a throttle butterfly body having at least two bosses one of which is fed with engine coolant, the bosses having bores to receive, respectively, a fuel pressure regulator; a decelerating air bypass; a cold start injector; an anti-overchoking thermostat, a thermostat for measuring engine coolant temperature; and a cold start injector air bypass.

10 Claims, 11 Drawing Figures

Figure 2:
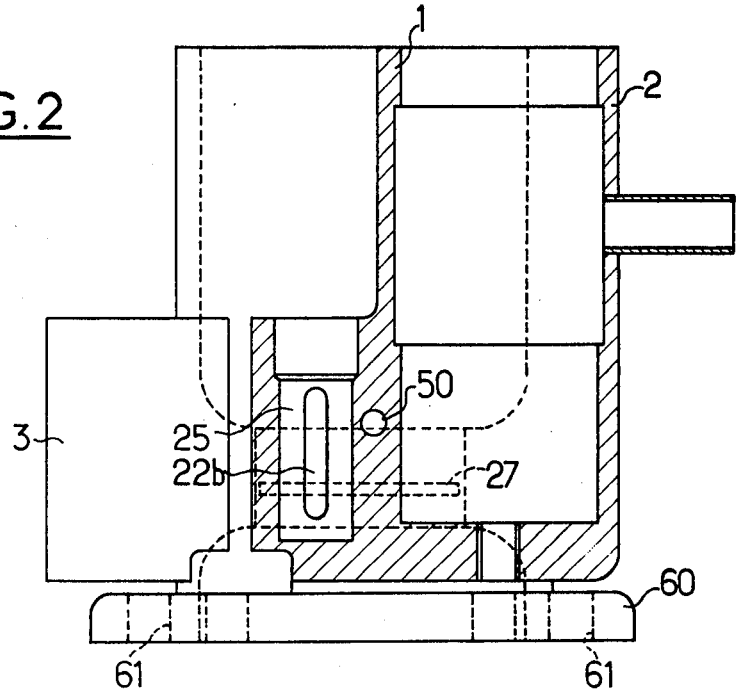

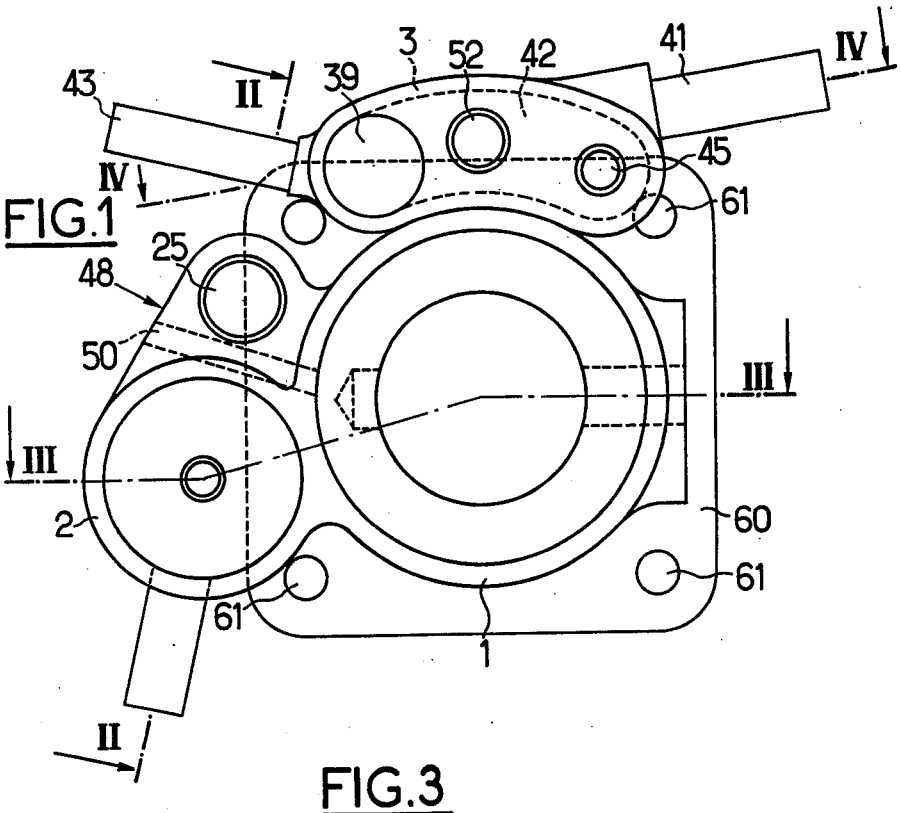
FIG.3
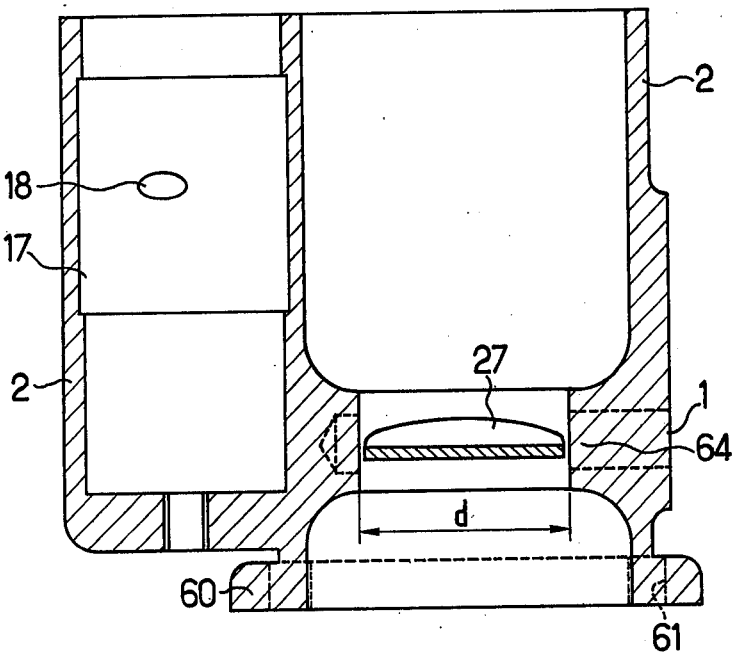

POSITION OF COLD START AIR CONTROL
10
9
8
7
6
5
4
3
2
1
-30 -20 -10 0 10 20 30 40 50
COOLANT TEMPERATURE

COLD START INJECTION TIME
12
11
10
9
8
7
6
5
4
3
2
1
0
-30 -20 -10 0 10 20 30
COOLANT TEMPERATURE

FUEL INJECTION SYSTEM

This invention relates to the supply of an air/fuel mixture to a fuel-injected internal combustion engine.

The conventional injection processes are known. Numerous auxiliaries must be used in order to provide the many functions, such as injection of fuel, starting from cold, activation (fuel enrichment and auxiliary air for the cold start device), and the supply of fuel under pressure.

A refined injection system (for example electronic injection) comprises at least six groups of corresponding auxiliaries for a four cylinder engine, i.e. four main injectors; a cold start injector fitted with an anti-overchoking device such as a thermal cut-out; a thermistor measuring engine temperature; a throttle butterfly bypass system supplying air for the cold start device, the sectional area of which is controlled by engine temperature; an optional throttle butterfly bypass, the opening of which is controlled by high vacuum only (for example during deceleration). This device is called the "decelerating air control" and is used for anti-pollution purposes during deceleration; and a fuel pressure regulator.

On the other hand, other functions peculiar to the engines must be provided in order to be able to adjust idling speed by means of a throttle butterfly bypass; to heat the throttle butterfly housing by means of engine coolant to prevent throttle butterfly icing-up during idling; and to ensure rebreathing of crankcase fumes.

In known techniques of fuel injection processes, manufacturers are obliged to fit the said auxiliaries in separate containers which entails the manufacture of large, complicated and costly inlet manifolds, and expensive special cylinder heads or at least special machining of standard cylinder heads used on carburettor version engines.

The disadvantages of adopting these methods involve the extremely high cost of assembling the injection system added to the cost of the injection process itself; difficult adaptation of the injection system to a production carburettor engine, the sale of injection systems in "kit" form is thus very costly and not practicable as a result.

An object of the invention is to provide a simple system enabling the already-mentioned disadvantages of cost and assembly to be eliminated in the knowledge that the afore-mentioned accessories, forming part of the injection process, fulfil essential functions.

The subject of the invention rests in the design of a throttle butterfly housing containing all of the above-mentioned functions working in conjunction with an inlet manifold.

Figure 4:
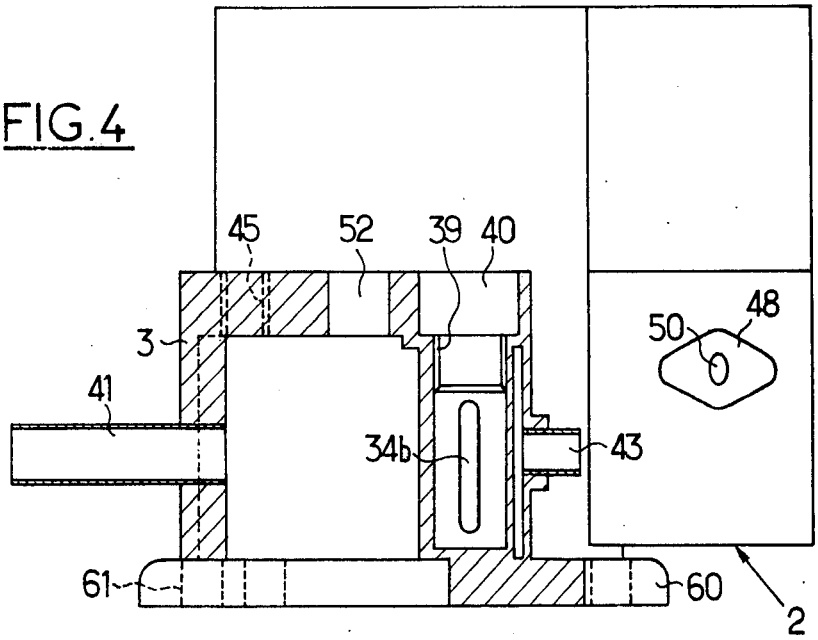
Figure 5:
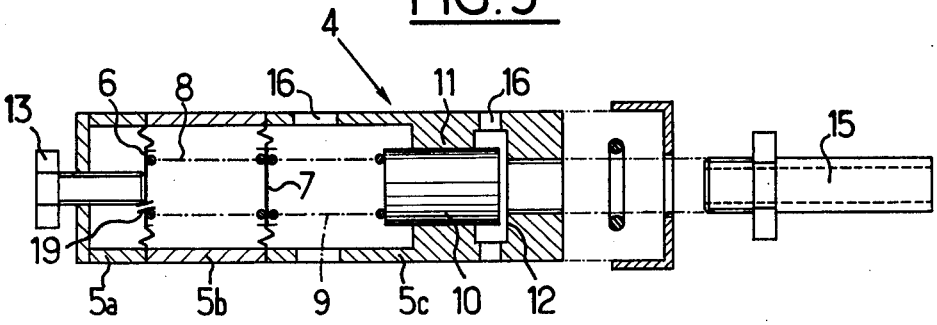
Figure 6:
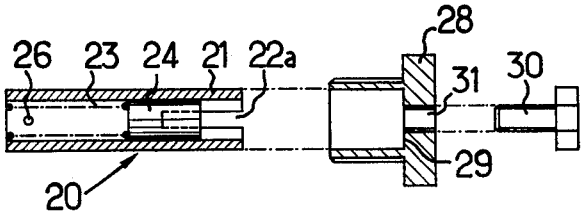
Figure 7:
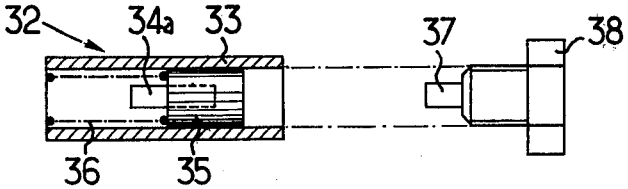
Figure 8:
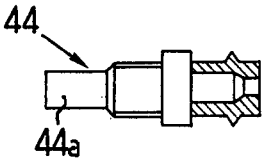
Figure 9:
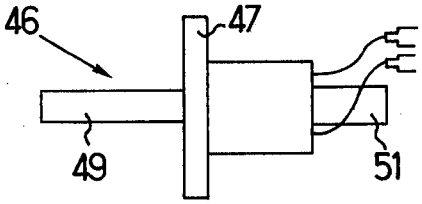
Figure 10:
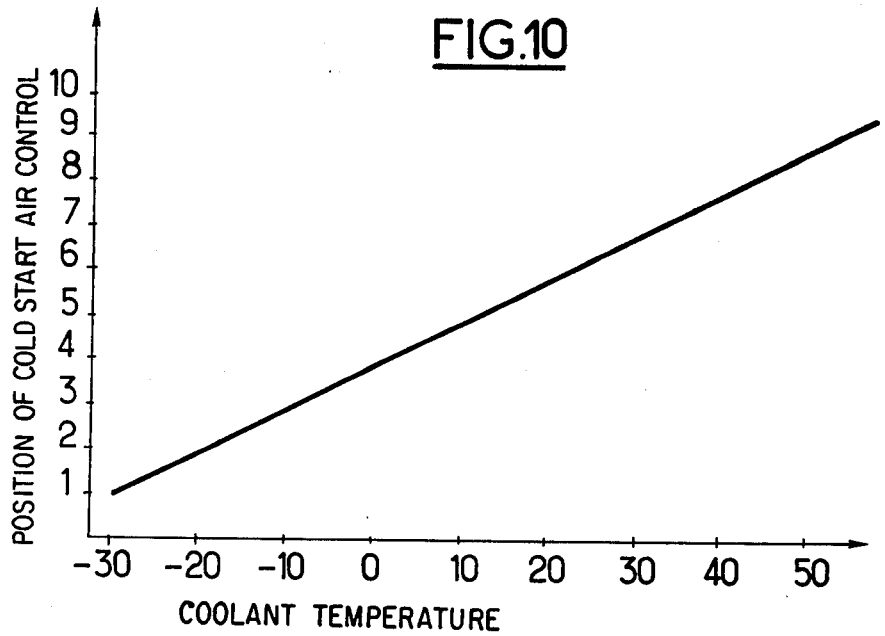
Figure 11:
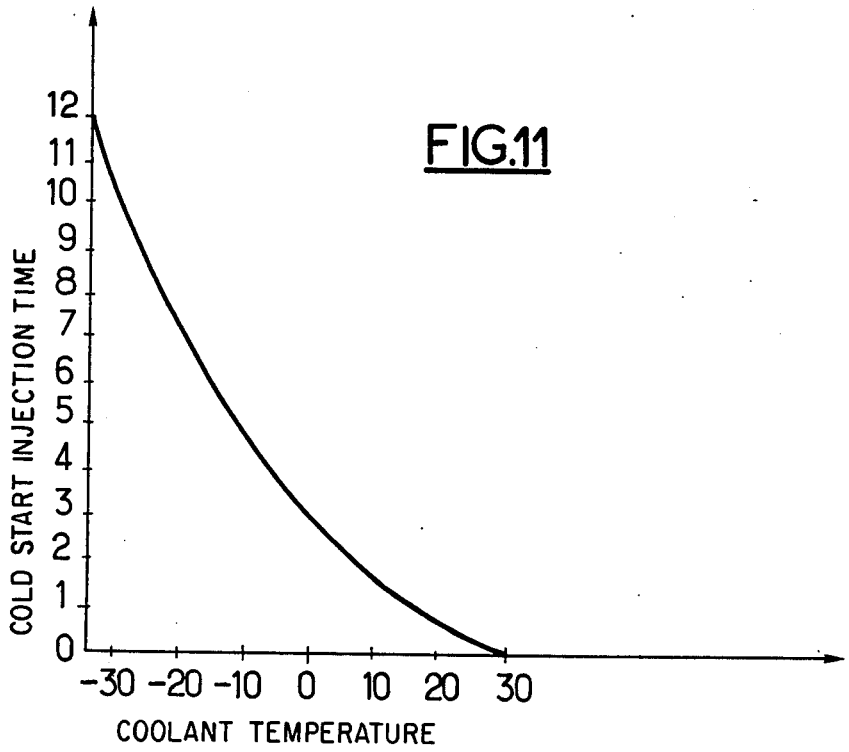

Other characteristics will become apparent from the description which follows of one embodiment, taken as an example, and illustrated in the attached drawings, in which:

FIG. 1 is a plan view of a throttle butterfly housing,

FIGS. 2, 3 and 4 are vertical cross sections of FIG. 1, respectively taken on the lines 11—11, 111—111 and 1V—1V of FIG. 1, FIG. 5 shows an axial section through a fuel pressure regulator, FIG. 6 shows an axial section through a decelerating air control unit, FIG. 7 shows an axial section through a cold starting air control device, FIG. 8 shows an axial section through an activating fuel enrichment probe, FIG. 9 is an internal view of a cold start injector, FIG. 10 is a graph illustrating the position of the cold start air control dependent on engine coolant temperature, and FIG. 11 is a graph illustrating the cold start injection time phase dependent on engine coolant temperature.

According to the embodiment illustrated in FIGS. 1 to 4, a throttle butterfly housing comprises a body 1 having two bosses 2 and 3 enabling the auxiliaries described hereinafter and illustrated in FIGS. 5 to 9 to be mounted.

As shown in FIG. 5, a fuel pressure regulator 4 comprises a body made up of three distance sleeves 5*a*, 5*b* and 5*c*, the distance sleeves 5*a* and 5*b* holding a diaphragm 6 between them, and the distance sleeves 5*b* and 5*c* holding a diaphragm 7 between them, the diaphragms 6 and 7 bearing respectively against opposite ends of a spring 8 of given stiffness.

A spring 9 with a stiffness calculated in relation to that of spring 8 bears simultaneously against the diaphragm 7 and against a piston 10 sliding in a cylindrical bore 11, the piston 10 resting against a seat 12, thus ensuring a seal for the fuel, when the fuel pump is stopped and no fuel is delivered (thus the fuel retains a residual pressure after the engine has been switched off). Fine adjustment of fuel pressure is provided by means of a screw 13. A hole and a threaded (or possibly crimped) end fitting 15, illustrated separately on the right of FIG. 5, serve to deliver fuel from the fuel pump to the pressure regulator 4.

Holes 16 serve to return the fuel to the vehicle fuel tank via an annular recess 17 and a hole 18 located and machined in the boss 2 (FIG. 3).

Atmospheric pressure exists between the diaphragms 6 and 7 due to a calibrated hole 19 (FIG. 5).

A thorough examination of how the pressure regulator works shows that the difference between the pressure of the fuel and atmospheric pressure remains constant and independent, in particular, in respect of fuel delivery and back pressure $P_2$, on condition that a spring 8 is used which is weak but has a long initial free length.

As shown in FIG. 6, a decelerating air control unit 20 comprises a body 21, which is only a distance sleeve with a machined slot 22*a* loacated at one end of the body 21, a spring 23 and a piston 24. The unit 20 is designed to fit inside a bore 25 in the throttle butterfly housing (FIGS. 1 and 2). A threaded plug 28 illustrated separately in FIG. 6 enables the unit 20 to be retained in the bore 25 and in particular for it to be prevented from turning, so that a communicating hole 26 allows the vacuum pressure present under a throttle butterfly 27 to pass (FIGS. 2 and 3). The unit 20 rests against a shoulder 29 in the threaded plug 28. A screw 30, screwing into a threaded hole 31 in the plug 28, enables the calibration of the spring 23 to be adjusted and the slot 22 to be more or less unmasked.

The advantage of this arrangement is that it allows the idling speed to be adjusted by turning the screw 30, and allows auxiliary air to enter during deceleration in order to solve the problem of unburnt hydrocarbon emission during deceleration; in fact, calculation shows that the depression present in the inlet manifold during deceleration reaches the piston 21 via the hole 26 and slots 22*a* and 22*b* (FIGS. 6 and 2 respectively), uncovering the throttle butterfly 27 both upstream and downstream thus creating a bypass of the throttle butterfly 27.

As shown in FIG. 7, a cold start air control 32 is similar in construction to the decelerating air control. It comprises a body 33 in which a machined slot 34*a* is unmasked by a piston 35, which is held in position on one side by a spring 36 and on the other side by a piston 37 (illustrated separately) in a wax capsule 38. The capsule enables the travel of the piston 37 to be in bi-univocal correspondence with engine coolant temperature, i.e., any given temperature corresponds to a single stroke magnitude as shown in the graph in FIG. 10.

The cold start air control 32 is designed to be located inside a bore 39 in the boss 3 on the throttle butterfly body (FIGS. 1 and 4), the bore having a thread 40 enabling the wax capsule to be screwed in, and a slot 34*b* forming a bypass for the throttle butterfly 27 in the same manner as the slot 22*b* (FIG. 2). The slots 34*a* and 34*b* are unmasked according to a law dependent on engine coolant temperature, as shown in the graph in FIG. 10. Hence, this unit enables the idling speed to be adjusted depending on the engine coolant temperature, and similarly enables correct engine idling to be ensured from the movement of starting from cold until the engine has attained normal working temperature.

Coolant circulation is provided in the boss 3 by an inlet pipe 41 (FIG. 4), a cavity 42 provided in the boss 3 and an outlet pipe 43. The cavity 42 and the boss 3 are also arranged to accept two other units referred to below.

In particular, electronic injection processes can provide the air/fuel mixture enrichment function during the engine warming up period by measuring coolant temperature using a temperature probe with, for example, a negative temperature coefficient. This probe 44 (FIG. 8) may be of any overall dimensions required, and provision has been made for a probe of reduced overall dimensions to be located in the threaded bore 45 (FIGS. 1 and 4), so that the tip 44*a* of the probe 44 is constantly dipped in engine coolant.

On the other hand, as shown in FIG. 9, the cold start injector 46, the function of which is to ensure a supply of additional fuel, when the engine is activated, in order to aid starting, comprises a lozenge-shaped support flange 47 of the same shape as the boss 48 (FIG. 4) to which it is fitted, and a cylindrical member 49 enabling fuel to be injected into the butterfly valve passage of boss 2 via a hole 50 upstream of the throttle butterfly 27 (FIGS. 1 and 3). The fuel injection hole 50 may be located downstream of the throttle butterfly, the precise location of the hole 50 depending on the results of development and testing carried out in a cold room. The cold start injector 46 is supplied with fuel from the fuel pump via a pipe 51.

When the cold start injector 46 (FIG. 9) is activated at the same time as the starter, it is possible in some instances that the engine refuses to start immediately. It is then necessary to stop the cold start injector from injecting fuel, in order to prevent over-choking of the engine even if the starter continues to be activated.

This function is ensured by a thermistor with a positive temperature coefficient (P.T.C.) inserted inside a probe, similar to the probe 44 (FIG. 8), which is located in the bore 52 in the boss 3 (FIG. 4) on the throttle butterfly housing. In fact this thermistor, through which the excitation current passes for the cold start injector, warms up and its resistance increases with time, more quickly as the engine coolant gets hotter. FIG. 11 is a graph showing the relationship between the maximum duration that the cold start injector functions and the temperature of the engine coolant.

Finally, the throttle butterfly body leaves the foundry with a boss 64 (FIG. 3) in which the bore is sufficiently small initially to be machined out later to a diameter *d* as required to suit the maximum performance of the engine.

The throttle butterfly housing illustrated in FIGS. 1 to 4 may be attached by its base flange 60 to the opening on a matching inlet manifold tract which has not been illustrated. The throttle butterfly housing is secured by four bolts or studs using holes 61. To keep production costs down, the inlet manifold has no heating circuit incorporated like those manifolds which are fitted with carburettors. However, they have the same shape as the inlet manifolds used with carburettors.

The throttle butterfly housing and matching inlet manifold assembly described above possess the following advantages. All of the auxiliary functions of a fuel injection system are combined together in the throttle butterfly housing; in consequence, normal production cylinder heads made for carburettor version engines need not be machined specially, and there is therefore a considerable saving in machining time. Heating of the throttle butterfly housing is carried out by engine coolant circulation used previously for heating the carburettor base. Hence, no special fittings are added for heating the throttle butterfly housing, and existing circuits may be used. Idling speed adjustment (screw 30) and the device (20) for treating unburnt hydrocarbons during deceleration operate from a common source. The inlet manifold is a conventional manifold already in use on carburettor version engines but with bosses for the injector holders incorporated, one for each cylinder, possibly one per pair of cylinders when the two inlet tracts are common to two cylinders, this being the practice on some engines with hemispherical heads, inclined parallel valves and inlet and exhaust manifolds fitted on the same side. On this type of engine, the injection system comprises only two injectors, an inlet manifold and a throttle butterfly body as described above, which are particularly economical. This arrangement has the additional advantage of possessing overall dimensions which are the equivalent of those for conventional carburettor assemblies and the usual complex devices for fuel supply and air distribution on indirect injection engines are eliminated.

The final advantage of this arrangement rests in the fact that the injection system according to the invention may be marketed in kit form through After-Sales outlets, which is very economical for the customer already in possession of a carburettor version engine.

The boss 64 may be machined to the required diameter to retain maximum engine performance. Hence, the throttle butterfly housing is a casting which will suit any type of engine.

I claim:

1. A compact fuel feed system for fuel-injected internal combustion engines, comprising a throttle butterfly housing incorporating all the essential auxiliaries in combination with an inlet manifold thus avoiding the use of independent casings, in which an engine air supply unit comprises the throttle butterfly body which has at least two bosses, a first one of which is to be fed with engine coolant; the second boss comprising an annular recess incorporating a fuel pressure regulator, a bore accepting a decelerating air bypass for treatment of unburnt hydrocarbons during the deceleration phase and including adjustment means for enabling the engine idling speed to be adjusted, and a boss accepting a cold start injector; said first boss comprising a first bore accepting a cold start injector air bypass, a second bore accepting a thermostat for measuring engine temperature and designed to ensure enrichment when the engine is started, and a third bore accepting an anti-overchoking thermostat for controlling the cold start injector.

2. A system according to claim 1, in which the fuel pressure regulator is designed to supply fuel under pressure independent of any back pressure, and includes two springs; a diaphragm separating said two springs; a piston which is movable by the pressure of the fuel delivered by a fuel pump and acts against one of said springs; a further diaphragm against which the other spring acts; and an adjusting screw for setting the position of said further diaphragm for enabling fine adjustment of the fuel pressure.

3. A system according to claim 1, in which the decelerating air bypass comprises a cylindrical body; and a piston within said body, which piston unmasks a slot according to the level of engine vacuum which is communicated to the interior of the body, which vacuum enables the piston to compress a spring when the vacuum becomes greater than a predetermined value, so that a certain quantity of air is fed via the slot to be injected directly downstream of the throttle butterfly.

4. A system according to claim 1, in which the cold start injector includes a cylindrical fuel feed member which is sufficiently long to feed the fuel direct to the throttle zone by passing through said second boss.

5. A system according to claim 1, in which the anti-overchoking thermostat includes a positive temperature coefficient thermistor for connection in series with a solenoid of the cold start injector.

6. A system according to claim 1, in which the thermostat for measuring engine coolant temperature comprises a thermistor with a negative temperature coefficient.

7. A system according to claim 1, in which the water temperature thermostat and the anti-overchoking thermostat have identical outer bodies.

8. A system according to claim 1, in which the cold start injector air bypass comprises a cylindrical body with an air bypass slot; a piston within the body which progressively unmasks the slot by movement against a spring acting on one end of the piston; and a wax capsule acting on the other end of the piston to move the piston by expansion of the capsule, the expansion being dependent on the temperature of the engine coolant circulated in said first boss.

9. A system according to claim 1, in which the throttle butterfly body is matched to an inlet manifold which is not heated by engine coolant, the inlet manifold being of the same pattern as that used for carburettors, having no air distributor, but comprising in addition one boss for an injector per cylinder.

10. A system according to claim 1, in which the throttle butterfly body and the matching inlet manifold are suitable in construction and dimensions to be interchangeable with the carburettor and inlet manifold on an engine already designed to be fed by a carburettor system.

* * * * *